US007573455B2

(12) United States Patent
Kim

(10) Patent No.: US 7,573,455 B2
(45) Date of Patent: Aug. 11, 2009

(54) ANALOG BUFFER AND METHOD FOR DRIVING THE SAME

(75) Inventor: Kee-Jong Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 835 days.

(21) Appl. No.: 11/023,624

(22) Filed: Dec. 29, 2004

(65) Prior Publication Data

US 2005/0156863 A1 Jul. 21, 2005

(30) Foreign Application Priority Data

Dec. 30, 2003 (KR) ..... 10-2003-0100826

(51) Int. Cl.
*G09G 3/36* (2006.01)

(52) U.S. Cl. ..... 345/100; 345/98

(58) Field of Classification Search ..... 345/76, 345/98, 100, 178, 204
See application file for complete search history.

(56) References Cited

U.S. PATENT DOCUMENTS 6,069,605 A * 5/2000 Ozawa ..... 345/98
6,407,732 B1 * 6/2002 Stiens et al. ..... 345/204

* cited by examiner

*Primary Examiner*—Amare Mengistu
*Assistant Examiner*—Yuk Chow
(74) *Attorney, Agent, or Firm*—McKenna Long & Aldridge LLP

(57) ABSTRACT

An analog buffer includes a comparator unit for comparing an input signal to be charged on a signal line of a display panel with an output signal charged on the signal line of the display panel to output a control signal; and a current switching unit for discharging an output current from the signal line of the display panel or charging an input current on the signal line of the display panel in accordance with the control signal output by the comparator unit the comparator unit smallest and to thus minimize leakage current.

14 Claims, 5 Drawing Sheets

ANALOG BUFFER AND METHOD FOR DRIVING THE SAME

The present invention claims the benefit of Korean Patent Application No. 2003-100826, filed in Korea on Dec. 30, 2003, which is hereby incorporated by reference.

BACKGROUND OF THE INVENTION

1. Field of the Invention

The present invention relates to an analog buffer, and more particularly, to an analog buffer for a flat panel display device.

2. Discussion of the Related Art

In general, among flat panel display devices for displaying images, thin film type flat panel display devices are thin and lightweight. The thin film type flat panel display devices have been recently developed because of their versatility. In particular, they are used in high resolution and high reaction speed liquid crystal display devices (LCD) that are capable of displaying moving pictures.

LCD devices use the optical anisotropy of liquid crystal molecules to transmit or block light transmission. Liquid crystal molecules transmit or block light depending upon their orientation. The orientation of the liquid crystal molecules can be controlled by applying an electric field.

Recently, active matrix type LCDs have been widely used because they provide excellent picture quality. In an active matrix LCD, pixels are arranged according to a matrix and image information is selectively supplied to the respective pixels through switching elements, such as thin film transistors (TFT), disposed in the respective pixels. A substrate used for the LCD is made of a transparent material, such as glass, which is cheap and is easily processed.

When the TFTs are made of polycrystalline silicon having high electron mobility, it is possible to increase switching speed and to reduce the size of the TFTs. However, since polycrystalline silicon is formed by high temperature fabrication processes, it is not possible to form the TFTs directly on the glass substrate of the LCD. Therefore, the TFTs formed on the glass substrate of the LCD are made of amorphous silicon formed using a low temperature fabrication process.

On the other hand, since a driving unit of the LCD needs a large number of switching elements to process digital signals, the driving unit is composed of a plurality of integrated circuits (IC) in which small transistors are integrated at high density. Therefore, the transistors used for the driving unit of the LCD must be made of polycrystalline silicon using high temperature fabrication processes.

Therefore, in the driving portion of the LCD, a plurality of ICs are separately formed on separate single crystalline silicon substrates. The integrated circuits are mounted on a tape carrier package (TCP). The integrated circuits are connected to the substrate of the LCD by a tape automated bonding (TAB) method or mounted on the substrate of the LCD by a chip-on-glass (COG) method to be combined with the substrate.

When the driving unit of the LCD is combined with the substrate by the TAB method or the chip-on-glass method, additional space is required for the driving portion of the LCD. Thus, it is difficult to miniaturize and to simplify the LCD. Moreover, as the number and the length of wiring lines for transmitting driving signals increase in larger displays, various noises and electromagnetic interference (EMI) are generated. Therefore, the reliability of larger displays deteriorates and manufacturing cost increases. Recently, advances in research on the formation of polycrystalline silicon using low temperature fabrication process have led to development of TFTs formed on the substrate of the LCD using polycrystalline silicon. As a result, an LCD integrated with a driving circuit in which a driving unit is mounted on the substrate of the LCD has been suggested.

FIG. 1 illustrates the structure of a related art liquid crystal display device (LCD) integrated with a driving circuit. Referring to FIG. 1, an LCD includes a liquid crystal display panel 10 in which gate lines 20 are horizontally arranged to be separated from each other by a predetermined distance and data lines 30 are vertically arranged to be separated from each other by a predetermined distance. The gate lines 20 and the data lines 30 cross each other. The gate lines and the data lines define pixel regions. A gate driving unit 50 is mounted on the liquid crystal display panel 10 to apply a scanning signal to the gate lines 20. A data driving unit 60 is mounted on the liquid crystal display panel 10 to apply a data signal to the data lines 30.

Pixel electrodes and TFTs are provided in the respective pixels 40. The TFTs include gate electrodes connected to the gate lines 20, source electrodes connected to the data lines 30, and drain electrodes connected to the pixel electrodes. Gate pads (not shown) and data pads (not shown) are formed at the ends of each of the gate lines 20 and the data lines 30.

The gate driving unit 50 sequentially applies the scanning signal to the gate lines through the gate pads and the data driving unit 60 applies the data signal to the data lines 30 through the data pads such that the pixels 40 of the liquid crystal display panel 10 are separately driven to display desired images by the liquid crystal display panel 10. The gate driving unit 50 and the data driving unit 60 mounted on the liquid crystal display panel 10 are simultaneously formed in a process of manufacturing the thin film transistor array substrate of the liquid crystal display panel 10.

The number and the length of data lines and gate lines increase in accordance with the resolution and the area of the driving circuit, thereby increasing the load. Also, since the amount of the data signal processed when driving the LCD significantly increases, the driving unit of the LCD must be driven at a higher speed. However, the load of the data lines and the gate lines can increase such that it is not possible to apply the desired signals in a short enough time. Therefore, an analog buffer capable of applying the desired signals in a short time in accordance with the load of the data lines and the gate lines is essential for proper operation at high resolution in a large area LCD.

In general, since the transistors made of single crystalline silicon have nearly identical electrical characteristics, these transistors can be used to design an operational amplifier to be used as the analog buffer. However, since the transistors made of polycrystalline silicon can have large differences in electrical characteristics, the operational amplifier designed with the polycrystalline silicon transistors has a large offset voltage and a large amount of power is consumed by static current such that the operational amplifier made of polycrystalline silicon transistors cannot be used as the analog buffer.

A driving circuit of a LCD needs an analog buffer that is insensitive to the differences in the electrical characteristics of the transistors made of polycrystalline silicon and that has a simple structure such that it is possible to reduce an occupied area and to reduce power consumption. A related art analog buffer that satisfies these requirements will be described in detail in reference to the attached drawings.

FIG. 2 illustrates an analog buffer in accordance with the related art. Referring to FIG. 2, the analog buffer includes a comparator for receiving an analog signal ANALOG_SIG through a first switch SW1 and a first capacitor C1 to correct variations in voltage of an output signal OUT_SIG applied to a data line D1, a second switch SW2 connected between the input port and the output port of the comparator COMP1, and a third switch SW3 connected between the first switch SW1 and the first capacitor C1. The first switch SW1 and the second switch SW2 are simultaneously turned on and off by a first control signal CS1. The third switch SW3 is turned on and off by a second control signal CS2.

FIG. 3 illustrates waveforms of a first control signal, a second control signal, and an output signal in the analog buffer depicted in FIG. 2. The driving of the related art analog buffer will be described in detail in reference to FIG. 3. Referring to FIG. 3, during an initialization period where a high voltage is applied as the first control signal CS1, the first switch SW1 is electrically connected such that the analog signal ANALOG_SIG is charged in the first capacitor C1 and the second switch SW2 is electrically connected such that the input port and the output port of the comparator COMP1 are initialized. Then, since a low voltage is applied as the second control signal CS2, the third switch SW3 is turned off. Therefore, during the initialization period, a voltage Vana-Vth obtained by subtracting a threshold voltage Vth of the comparator COMP1 from the voltage value Vana of the analog signal ANALOG_SIG is charged in the first capacitor C1.

During a signal application period where a high voltage is applied as the second control signal CS2, the third switch SW3 is electrically connected such that the voltage value Vana of the analog signal ANALOG_SIG is applied as the output signal OUT_SIG to the data line D1 through the electrically connected third switch SW3. Then, since a low voltage is applied as the first control signal CS1, the first switch SW1 and the second switch SW2 are turned off.

According to the related art analog buffer driven as described above, during the initialization period, an offset voltage is stored in the first capacitor C1 and, at the same time, the input port and the output port of the comparator COMP1 are initialized to correct the error corresponding to the difference in the electrical characteristics of the transistors forming the comparator COMP1. During the signal application period, the voltage value Vana of the analog signal ANALOG_SIG is applied as the output signal OUT_SIG to the data line D1 through the electrically connected third switch SW3.

When the voltage of the output signal OUT_SIG applied to the data line D1 changes, the comparator COMP1 changes the voltage of the input port to increase or reduce the voltage value Vana of the analog signal ANALOG_SIG together with the first capacitor C1. Specifically, when the voltage of the output signal OUT_SIG applied to the data line D1 rises, the voltage of the input port of the comparator COMP1 falls such that the comparator COMP1 reduces the voltage value Vana of the analog signal ANALOG_SIG together with the first capacitor C1. In contrast, when the voltage of the output signal OUT_SIG applied to the data line D1 falls, the voltage of the input port of the comparator COMP1 rises such that the comparator COMP1 increases the voltage value Vana of the analog signal ANALOG_SIG together with the first capacitor C1. Since the voltage value Vana of the analog signal ANALOG_SIG that is increased or reduced as described above is applied as the output signal OUT_SIG to the data line D1 through the third switch SW3, the change in the voltage of the output signal OUT_SIG is corrected such that a corrected voltage is applied to the data line D1.

Since the above-described related art analog buffer is driven in a state where the offset voltage is applied to the input port of the comparator COMP1, leakage current flows from the comparator COMP1. For example, in an experiment for testing the driving of a display panel through the above-described analog buffer, leakage current of about 80 μW is generated by the comparator COMP1 in a state where the offset voltage is applied to the input port of the comparator COMP1. In the case of a high resolution and large area LCD in which the load of the data line D1 connected to the output port of the comparator COMP1 is large, the size of the comparator COMP1 must be increased, thereby increasing leakage current and power consumption.

SUMMARY OF THE INVENTION

Accordingly, the present invention is directed to an analog buffer and a method for driving the same that substantially obviate one or more of the problems due to limitations and disadvantages of the related art.

An object of the present invention is to provide an analog buffer with a leakage current blocking capability.

Another object of the present invention is to provide an analog buffer having low power consumption.

Another object of the present invention is to provide an analog buffer that improves a color picture display.

Additional features and advantages of the invention will be set forth in the description that follows, and in part will be apparent from that description, or may be learned by practice of the invention. The objectives and other advantages of the invention will be realized and attained by the structure particularly pointed out in the written description and claims hereof as well as shown in the appended drawings.

To achieve these and other advantages and in accordance with the purpose of the present invention, as embodied and broadly described, an analog buffer includes a comparator unit for comparing an input signal to be charged on a signal line of a display panel with an output signal charged on the signal line of the display panel to output a control signal; and a current switching unit for discharging an output current from the signal line of the display panel or charging an input current on the signal line of the display panel in accordance with the control signal output by the comparator unit the comparator unit smallest and to thus minimize leakage current.

In another aspect, an analog buffer includes a first comparator for receiving an input signal to be charged on a signal line through a first switch and a first capacitor; a second switch connected between an input port and an output port of the first comparator to initialize the input port and the output port of the first comparator; a second comparator for receiving an output signal of the first comparator through a second capacitor to output a control signal; a third switch connected between an input port and an output port of the second comparator to initialize the input port and the output port of the second comparator; a first current source for discharging an output current from the signal line through an eleventh switch turned on or turned off by the control signal output by the second comparator; a second current source for charging an input current on the signal line through a twelfth switch turned on or turned off by the control signal of the second comparator; and a fourth switch for applying the input signal charged within the first capacitor in the signal line.

In another aspect, an analog buffer includes a first comparator for receiving an input signal to be charged on a signal line through a first switch and a first capacitor; a second switch connected between an input port and an output port of the first comparator to initialize the input port and the output port of the first comparator; a second comparator for receiving the output signal of the first comparator through a second capacitor to output a control signal; a third switch connected between an input port and an output port of the second comparator to initialize the input port and the output port of the second comparator; a first current source for discharging current from the signal line through an eleventh switch turned on and off by the control signal output by the second comparator; a second current source for charging current on the signal line through a twelfth switch turned on and off by the control signal output by the second comparator; a third capacitor connected between the input port of the first comparator and the signal line; and a fourth switch for electrically connecting the input port of the first comparator to the signal line or isolating the input port of the first comparator from the signal line.

In another aspect, a method of driving an analog buffer includes comparing an input signal to be charged on a signal line of a display panel with an output signal charged on the signal line of the display panel; discharging an output current from the signal line of the display panel or charging an input current on the signal line of the display panel in accordance with a result of comparing the input signal with the output signal; correcting a level of the output signal which is higher than a desired level; and stopping a charge or discharge of a leakage current.

In another aspect, a method of driving an analog buffer includes initializing an input port and an output port of a comparator unit; comparing an input signal to be charged on a signal line of a display panel with an output signal charged on the signal line of the display panel; changing the level of the control signal of the comparator unit to charge an input current on the signal line when a level of the input signal is higher than a level of the output signal; and changing the level of the control signal of the comparator unit to discharge an output current from the signal line when the level of the input signal is lower than the level of the signal line.

It is to be understood that both the foregoing general description and the following detailed description are exemplary and are intended to provide further explanation of the invention as claimed.

BRIEF DESCRIPTION OF THE DRAWINGS

The accompanying drawings, which are included to provide a further understand of the invention and are incorporated in and constitute a part of this specification, illustrate embodiments of the invention and together with the description serve to explain the principles of the invention

DETAILED DESCRIPTION OF THE PREFERRED EMBODIMENTS

Reference will now be made in detail to the preferred embodiments of the present invention, examples of which are illustrated in the accompanying drawings.

Figure 1:
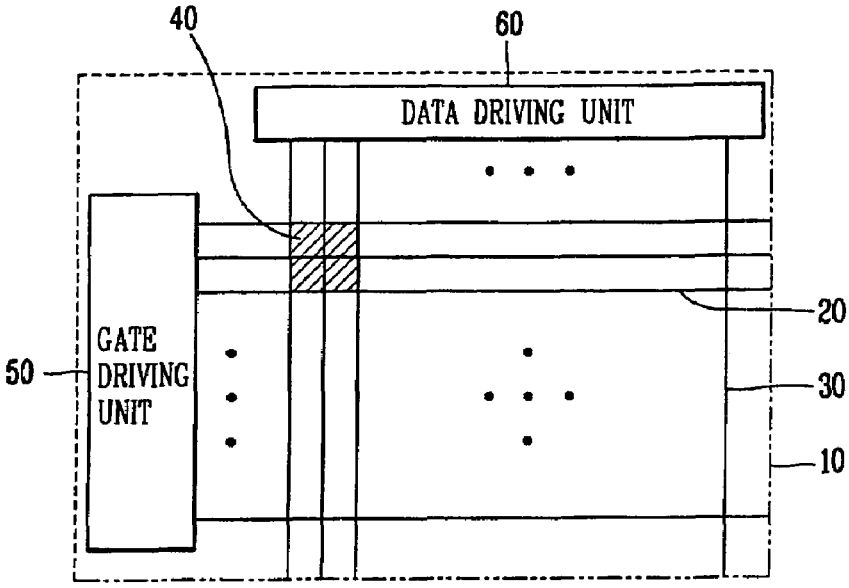
FIG. 1 RELATED ART
FIG. 1 illustrates the structure of a related art liquid crystal display device (LCD) integrated with a driving circuit.
Figure 2:
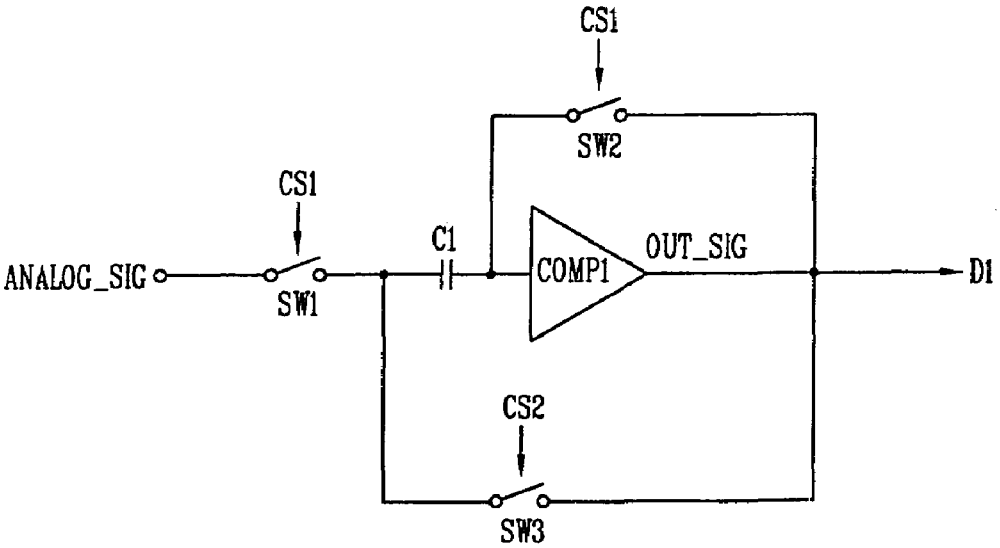
FIG. 2 RELATED ART
FIG. 2 illustrates an analog buffer in accordance with the related art.
Figure 3:
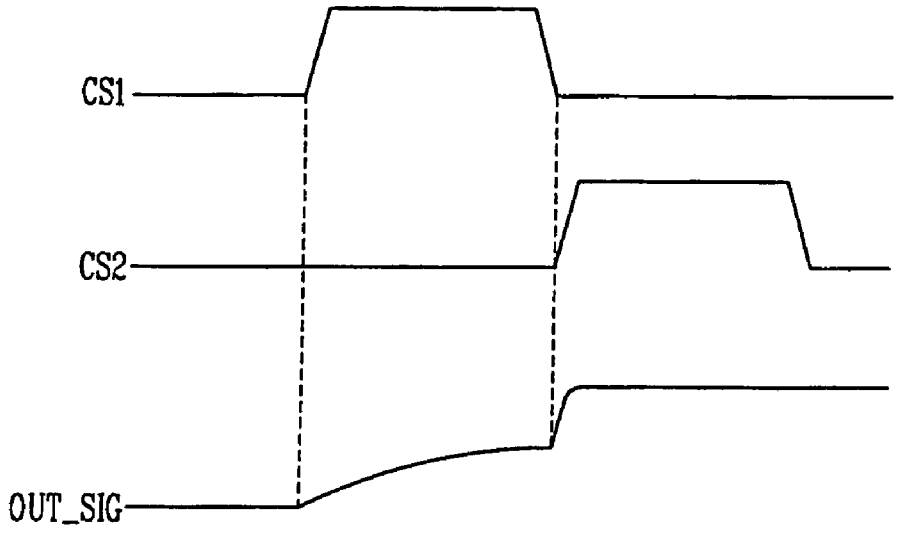
FIG. 3 RELATED ART
FIG. 3 illustrates waveforms of a first control signal, a second control signal, and an output signal in the analog buffer depicted in FIG. 2.
Figure 4:
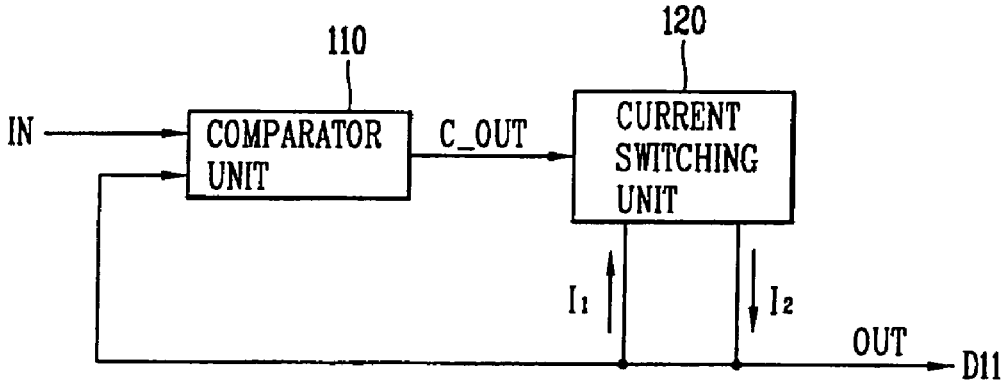
FIG. 4 is a block diagram illustrating an exemplary analog buffer according to an embodiment of the present invention.

FIG. 4 is a block diagram illustrating an exemplary analog buffer according to an embodiment of the present invention. Referring to FIG. 4, the analog buffer includes a comparator unit 110 and a current switching unit 120. The comparator unit 110 compares an input signal IN to be charged on a data line D11 of a display panel with an output signal OUT charged on the data line D11 of the display panel to output a control signal C_OUT. In response to the control signal C_OUT, the current switching unit 120 discharges a current I1 from the data line D11 or charges a current I2 on the data line D11.

Figure 5:
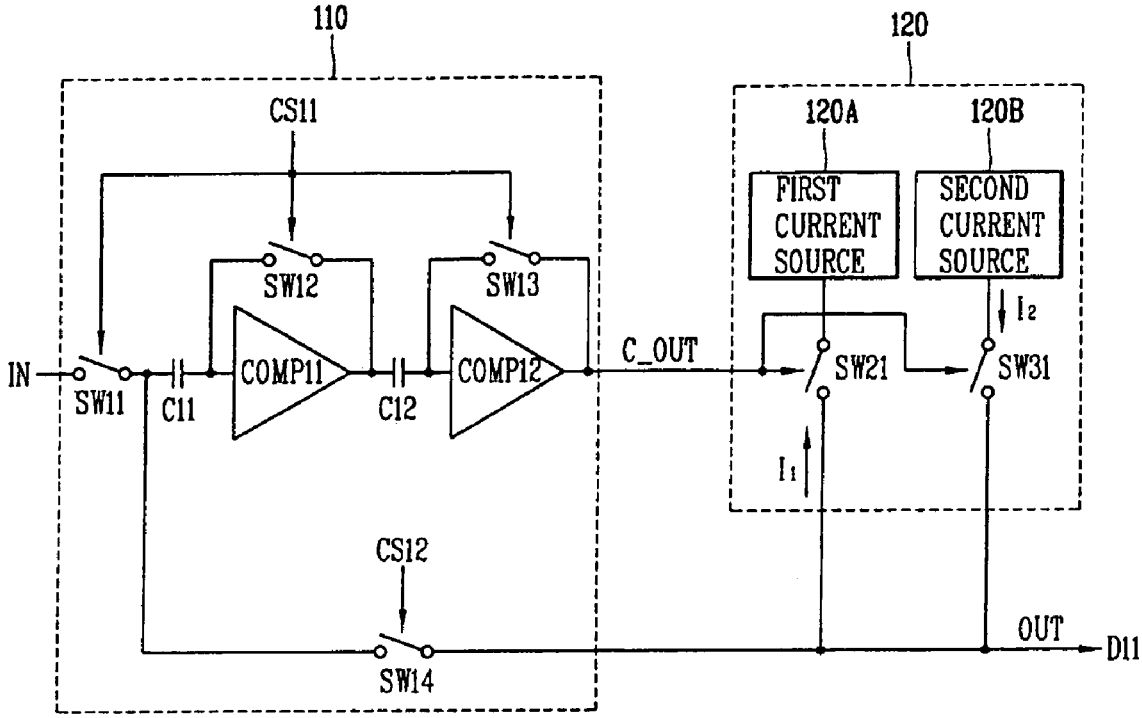
FIG. 5 is an exemplary circuit diagram of an analog buffer according to an embodiment of the present invention.

FIG. 5 is an exemplary circuit diagram of an analog buffer according to an embodiment of the present invention. Referring to FIG. 5, the comparator unit 110 includes a first comparator COMP11 and a second comparator COMP12. The first comparator COMP11 receives the input signal IN to be charged in the data line D11 through a first switch SW11 and a first capacitor C11. A second switch SW12 is connected between the input port and the output port of the first comparator COMP11 and initializes the input port and the output port. The second comparator COMP12 receives an output signal of the first comparator COMP11 through a second capacitor C12 and output the control signal C_OUT. A third switch SW13 is connected between the input port and the output port of the second comparator COMP12 and initializes the input port and the output port. A fourth switch SW14 applies the input signal IN charged in the first capacitor C11 to the data line D11.

The first to third switches SW11 to SW13 are simultaneously turned on or off by a first control signal CS11. The fourth switch SW14 is electrically controlled by a second control signal CS12. The first control signal CS11 has a waveform that includes periodic pulses having a predetermined interval. A waveform of the second control signal CS12 is the inverse of the waveform of the first control signal CS11. Thus, the first to third switches SW11 to SW13 and the fourth switch SW14 are alternately switched on and off.

The first to third switches SW11 to SW13 may include transistors whose gate electrodes receive the first control signal CS11 such that the transistors are simultaneously turned on or off. The fourth switch SW14 may include a transistor whose gate electrode receives the second control signal CS12 such that the transistor is turned on or turned off. For example, the first to fourth switches SW11 to SW14 may be composed of N-type MOS transistors or P-type MOS transistors.

The first to third switches SW11 to SW13 may each include a pair of N-type and P-type transistors whose respective gate electrodes receive the first control signal CS11 and an inverted first control signal CS11 to transmit signals applied to commonly connected source electrodes to commonly connected drain electrodes, or intercept signal applied to commonly connected source electrodes from commonly connected drain electrodes. The fourth switch SW14 may include a pair of N-type and P-type transistors whose respective gate electrodes receive the second control signal CS12 and an inverted second control signal CS12 to transmit signals applied to commonly connected source electrodes to commonly connected drain electrodes, or intercept signals applied to commonly connected source electrodes from commonly connected drain electrodes. The pair of N-type and P-type transistors having the above-described structure are referred to as transmission gates.

The first comparator COMP11 and the second comparators COMP11 and COMP12 may be composed of inverters or voltage amplifiers. A resistor for preventing noise from being generated in an output signal OUT and a switch for pre-charging or resetting the data line D11 may be further included between the fourth switch SW14 and the data line D11.

Still referring to FIG. 5, the current switching unit 120 includes a first current source 120A and a second current source 120B. The first current source 120A discharges the current I1 from the data line D11 through an eleventh switch SW21. The eleventh switch SW21 is turned on and off in accordance with the control signal C_OUT from the second comparator COMP12. The second current source 120B charges the current I2 on the data line D11 through a twelfth switch SW31 which is turned on and off in accordance with the control signal C_OUT of the second comparator COMP12.

Figure 6:
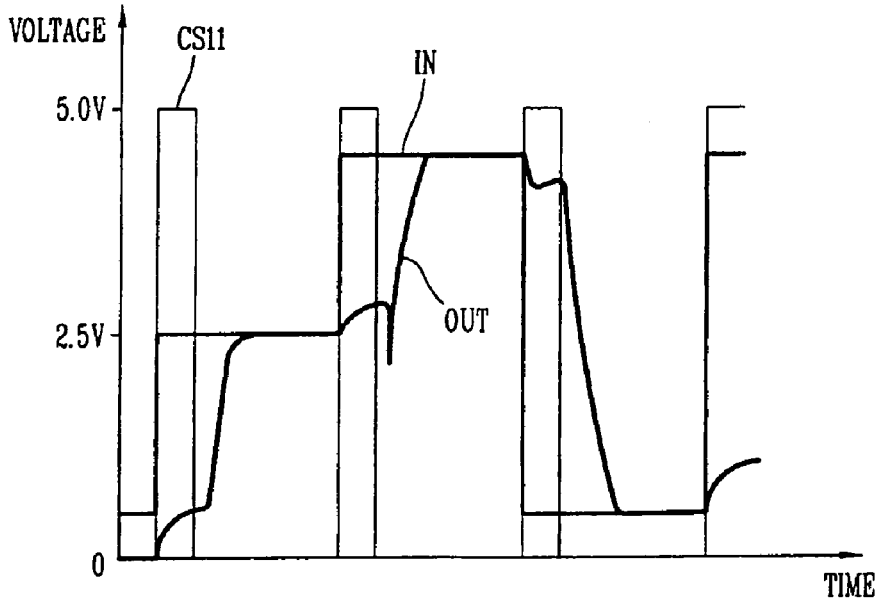
FIG. 6 illustrates an exemplary waveform corresponding to the exemplary circuit diagram of the analog buffer depicted in FIG. 5.

FIG. 6 illustrates an exemplary waveform corresponding to the exemplary circuit diagram of the analog buffer depicted in FIG. 5. The driving of the analog buffer according to an embodiment of the present invention will be described in detail with reference to FIG. 6.

During an initialization period, a high voltage is applied as the first control signal CS11 to the comparator unit 110. Then, the first switch SW11 is switched on such that the input signal IN to be charged on the data line D11 of the display panel is charged within the first capacitor C11. The second switch SW12 is switched on. Thus, the input port and the output port of the first comparator COMP11 are initialized.

Since the second switch SW12 is turned on, the input signal IN is charged in the second capacitor C12. Thus, the third switch SW13 is turned on, and the input port and the output port of the second comparator COMP12 are initialized. On the other hand, during the initialization period, the fourth switch SW14 is turned off by applying a low voltage as the second control signal CS12. Then, the data line D11 is reset.

During the initialization period, a difference voltage obtained by subtracting a threshold voltage Vth of the first comparator COMP11 from the voltage value of the input signal IN is charged in the first capacitor C11. Then, after the input port and the output port of the second comparator COMP12 have been initialized by the third switch SW13, the control signal C_OUT output by the second comparator COMP12 has a medium level voltage value such that the first current source 120A and the second current source 120B are turned off.

During a signal application period, a high voltage is applied as the second control signal CS12. The first to third switches SW11 to SW13 are turned off and the fourth switch SW14 is turned on. Thus, the input signal IN stored in the first capacitor C11 is applied as the output signal OUT to the data line D11 through the fourth switch SW14.

The first comparator COMP11 and the second comparator COMP12 of the comparator unit 110 compare the input signal IN with the output signal OUT. The first comparator COMP11 and the second comparator COMP12 raise the level of the control signal C_OUT output from the second comparator COMP12 when the level of the input signal IN is higher than the level of the output signal OUT. The first comparator COMP11 and the second comparator COMP12 reduce the level of the control signal C_OUT output from the second comparator COMP12 when the level of the input signal IN is lower than the level of the output signal OUT.

When the level of the control signal C_OUT output from the second comparator COMP12 rises, the second current source 120B is driven such that current I2 is charged on the data line D11. In contrast, when the level of the control signal C_OUT output from the second comparator COMP12 is low, the first current source 120A is driven such that the current I1 from the data line D11 is discharged. When the current I2 is charged on the data line D11 by the second current source 10B or the current I1 from the data line D11 is discharged by the first current source 110A, the level of the input signal IN is made equal to the level of the output signal OUT. Then, the control signal C_OUT output from the second comparator COMP12 has a medium level voltage value such that the driving states of the second current source 120B and the first current source remain unchanged.

The analog buffer driven in accordance with the embodiment of the present invention described above compares the level of the input signal to be charged on the data line with the level of the output signal charged on the data line such that current is charged on the data line or current is discharged from the data line through a current switching unit and that the level of the input signal is made equal to the level of the output signal. Then, the analog buffer holds the driving of the current switching unit such that leakage current is blocked in a circuit stand-by mode excluding the charge and the discharge of the data lines.

In the analog buffer according to an embodiment of the present invention, since the output port of the comparator unit is not connected to the data line, even when the load of the data line is large in a high resolution and large area LCD, it is possible to reduce the size of the comparator unit to minimize the amount of leakage current. On the other hand, in the analog buffer according to an embodiment of the present invention, when the level of the output signal charged in the data line is higher than the desired level of the data signal, which is referred to as an overshoot phenomenon, the current switching unit is driven in real time in accordance with the comparison result of the comparator unit. Thus, it is possible to stabilize and maintain a correct level for the output signal charged in the data line.

Figure 7:
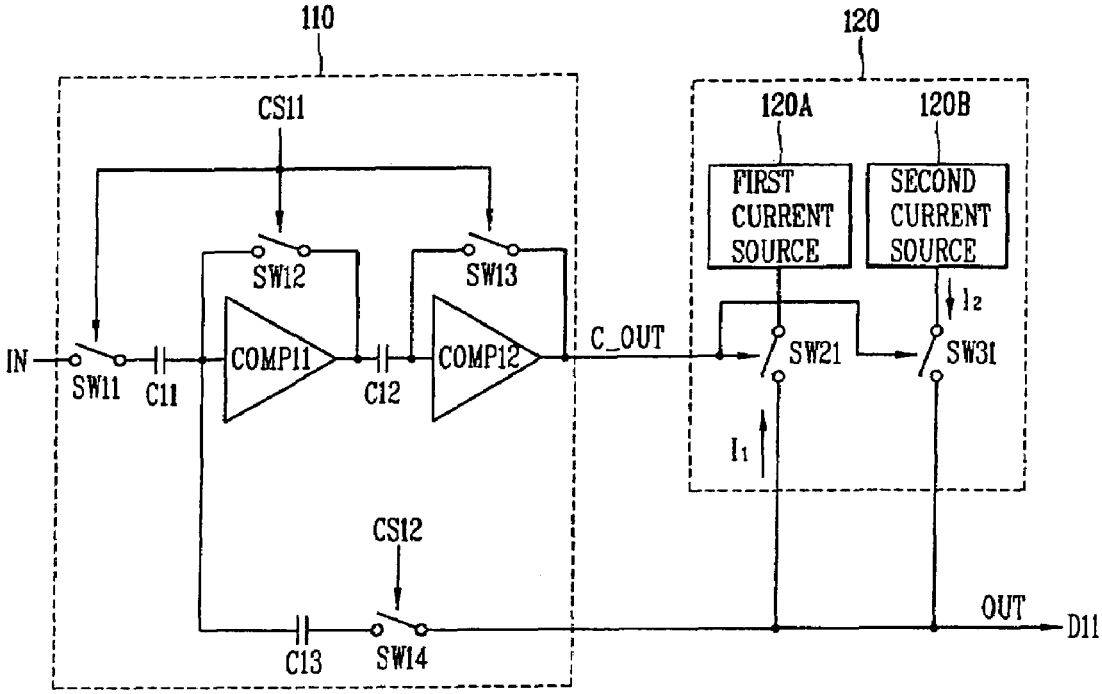
FIG. 7 is an exemplary circuit diagram of an analog buffer according to another embodiment of the present invention.

FIG. 7 is an exemplary circuit diagram of an analog buffer according to another embodiment of the present invention. Referring to FIG. 7, the comparator unit 110 includes a first comparator COMP11 and a second comparator COMP12. The first comparator COMP11 receives the input signal IN to be charged on the data line D11 through a first switch SW11 and a first capacitor C11. A second switch SW12 is connected between the input port and the output port of the first comparator COMP11 to initialize the input port and the output port. A second comparator COMP12 receives the output signal from the first comparator COMP11 through the second capacitor C12 and outputs the control signal C_OUT. A third switch SW13 is connected between the input port and the output port of the second comparator COMP12 and initializes the input port and the output port. A third capacitor C13 is connected between the input port of the first comparator COMP11 and a fourth switch SW14. The fourth switch SW14 is connected between the third capacitor C13 and the data line D11 and isolates the input port of the first comparator COMP11 from the data line D11 through the third capacitor C13.

The first to third switches SW11 to SW13 are simultaneously turned on or off by the first control signal CS11. The fourth switch SW14 is turned on or off by the second control signal CS12. A periodic waveform including pulses having a predetermined period is applied to the first control signal CS11. A waveform applied to the second control signal CS12 is the inverse of the waveform applied to the first control signal CS11. Therefore, the first to third switches SW11 to SW13 and the fourth switch SW14 are alternately turned on and off.

As discussed above, the first to fourth switches SW11 to SW14 can include N-type MOS transistors or P-type MOS transistors or transmission gates. The first comparator COMP11 and the second comparator COMP12 can include inverters or voltage amplifiers. A resistor for preventing noise generation in the output signal OUT and a switch for pre-charging or resetting the data line D11 may be further included between the fourth switch SW14 and the data line D11.

The current switching unit 120 includes a first current source 120A and a second current source 120B. The first current source 120A discharges a current I1 from the data line D11 through an eleventh switch SW21 which is turned on or off in accordance with the control signal C_OUT of the second comparator COMP12. The second current source 120B charges a current I2 on the data line D11 through a twelfth switch SW31 which is turned on or off in accordance with the control signal C_OUT of the second comparator COMP12.

As described above in reference to FIG. 5, the first current source 120A and the second current source 120B can include current mirror type circuits. The eleventh switch SW21 and the twelfth switch SW31 may include P-type MOS transistors or N-type MOS transistors.

Figure 8:
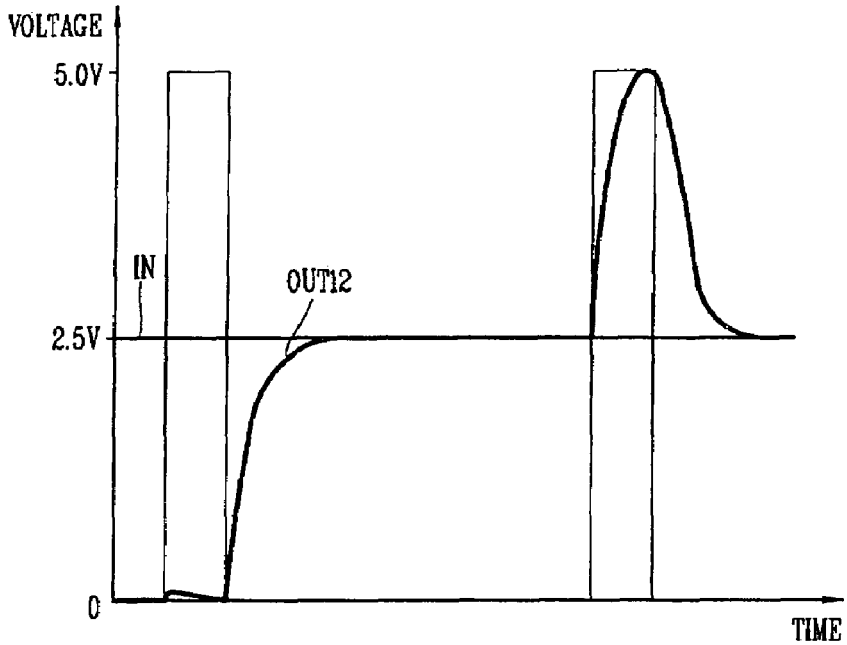
FIG. 8 illustrates an exemplary waveform corresponding to the exemplary circuit diagram of the analog buffer depicted in FIG. 7.

FIG. 8 illustrates an exemplary waveform corresponding to the exemplary circuit diagram of the analog buffer depicted in FIG. 7. The driving of the analog buffer according to another embodiment of the present invention will be described in detail with reference to FIG. 8.

During an initialization period a high voltage is applied as the first control signal CS11 to the comparator unit 110. The first switch SW11 is turned on. Thus, the input signal IN to be charged on the data line D11 of the display panel is charged in the first capacitor C11. The second switch SW12 is also turned on. Thus, the input port and the output port of the first comparator COMP11 are initialized. Since the second switch SW12 is turned on, the input signal IN is charged in the second capacitor C12 and the third switch SW13 is also turned on. Thus, the input port and the output port of the second comparator COMP12 are initialized.

Further, during the initialization period, a high voltage is applied as the first control signal CS11. A low voltage is applied as the second control signal CS12 is to turn off the fourth switch SW14. Then, the data line D11 is reset.

A difference voltage obtained by subtracting a threshold voltage Vth of the first comparator COMP11 from the voltage value of the input signal IN is charged on the first capacitor C11 during the initialization period. Then, since the input port and the output port of the second comparator COMP12, which include inverters, are initialized by the third switch SW13, the control signal C_OUT output by the second comparator COMP12 has a medium level voltage value. Thus, the first current source 120A and the second current source 120B are not driven.

During a signal application period, a high voltage is applied as the second control signal CS12. The first to third switches SW11 to SW13 are turned off and the fourth switch SW14 is turned on. Thus, the data line D11 is electrically connected to the input port of the first comparator COMP11 through the third capacitor C13. Thus, the output signal OUT of the data line D11 is controlled by the ratio of the capacitance of the first capacitor C11 to the capacitance of the third capacitor C13.

The first comparator COMP11 and the second comparator COMP12 of the comparator unit 110 compare the input signal IN with the output signal OUT. The first comparator COMP11 and the second comparator COMP12 raise the level of the control signal C_OUT output from the second comparator COMP12 when the level of the input signal IN is higher than the level of the output signal OUT. The first comparator COMP11 and the second comparator COMP12 reduce the level of the control signal C_OUT output from the second comparator COMP12 when the level of the input signal IN is lower than the level of the output signal OUT.

When the level of the control signal C_OUT output from the second comparator COMP12 rises, the second current source 120B is driven such that current I2 is charged on the data line D11. In contrast, when the level of the control signal C_OUT output from the second comparator COMP12 is low, the first current source 120A is driven such that the current I1 from the data line D11 is discharged. When the current I2 is charged on the data line D11 by the second current source 10B or the current I1 from the data line D11 is discharged by the first current source 110A, the level of the input signal IN is made equal to the level of the output signal OUT. Then, the control signal C_OUT output from the second comparator COMP12 has a medium level voltage value such that the driving states of the second current source 120B and the first current source remain unchanged.

The analog buffer driven in accordance with the other embodiment of the present invention described above compares the level of the input signal to be charged on the data line with the level of the output signal charged on the data line such that current is charged on the data line or current is discharged from the data line through a current switching unit and that the level of the input signal is made equal to the level of the output signal. Then, the analog buffer holds the driving of the current switching unit such that leakage current is blocked in a circuit stand-by mode excluding the charge and the discharge of the data lines.

In the analog buffer according to an embodiment of the present invention, since the output port of the comparator unit is not connected to the data line, even when the load of the data line is large in a high resolution and large area LCD, it is possible to reduce the size of the comparator unit to minimize the amount of leakage current. On the other hand, in the analog buffer according to the other embodiment of the present invention, when the level of the output signal charged in the data line is higher than the desired level of the data signal, which is referred to as an overshoot phenomenon, the current switching unit is driven in real time in accordance with the comparison result of the comparator unit such that it is possible to stabilize and maintain a correct level for the output signal charged in the data line.

Figure 9:
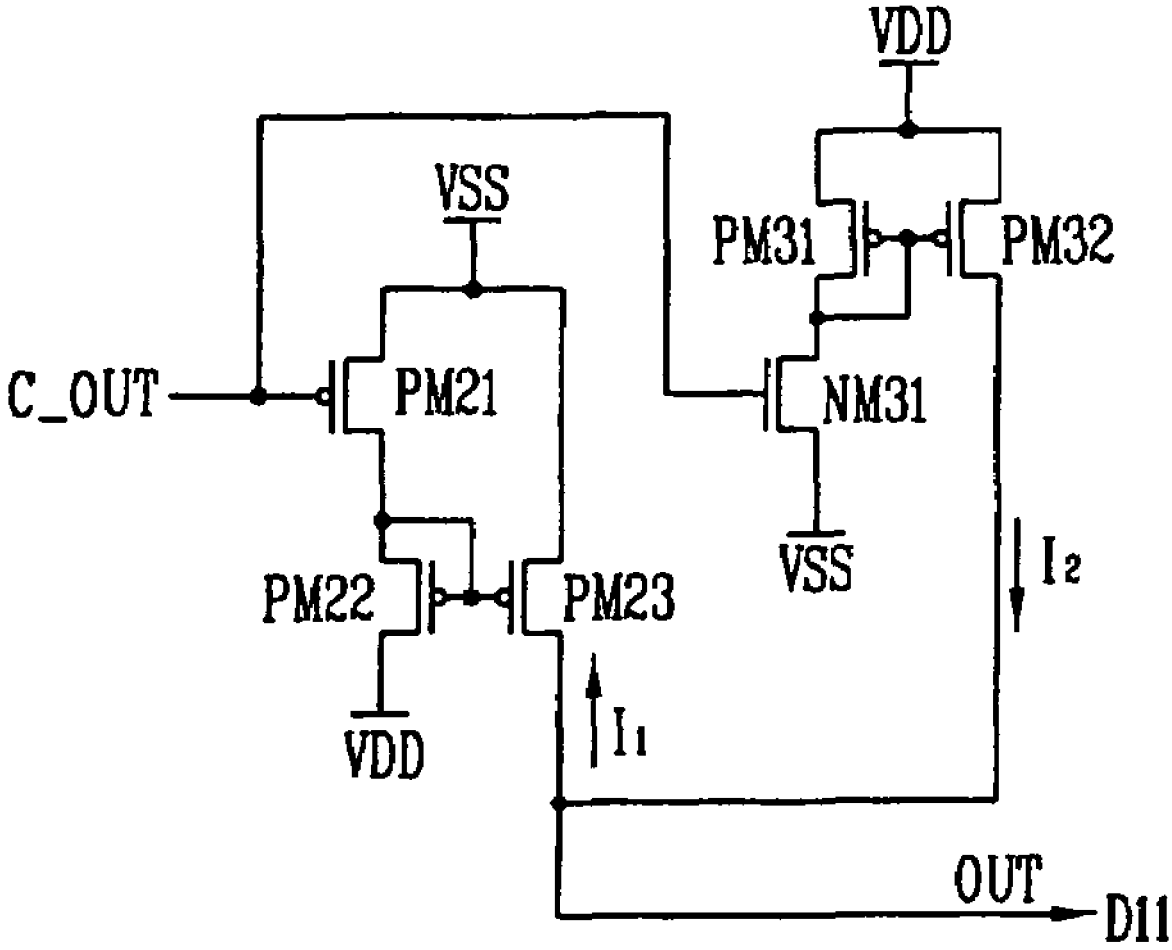
FIG. 9 is a circuit diagram illustrating an exemplary current switching unit according to an embodiment of the present invention.

FIG. 9 is a circuit diagram illustrating an exemplary current switching unit according to an embodiment of the present invention. The current switching unit depicted in FIG. 9 is an exemplary circuit diagram for the current switching unit 120 illustrated in FIGS. 5 and 7, which includes the first current source 120A and the second current source 120B. In the embodiment of the present invention shown in FIG. 9, the first current source 120A and the second current source 120B are implemented with current mirror type circuits, and the eleventh switch SW21 and the twelfth switch SW31 are each implemented with a P-type MOS transistor and an N-type MOS transistor.

Referring to FIG. 9, the first current source 120A (shown in FIGS. 5 and 7) includes a first P-type MOS transistor PM22 and a second P-type MOS transistor PM23. The drain electrode of the first P-type MOS transistor PM22 is connected to a ground potential VSS through an third P-type MOS transistor PM21. The third P-type MOS transistor PM21 is switched on and off by the control signal C_OUT of the second comparator COMP12. The gate electrode of the first P-type MOS transistor PM22 is connected to the drain electrode of the first P-type MOS transistor PM22. The source electrode of the first P-type MOS transistor PM22 is connected to a power voltage source VDD. The drain electrode of the second P-type MOS transistor PM23 is connected to the ground potential VSS. The gate electrode of the second P-type MOS transistor PM23 is connected to the gate electrode of the first P-type MOS transistor PM22. The source electrode of the second P-type MOS transistor PM23 is connected to the data line D11.

The second current source 120B (shown in FIGS. 5 and 7) includes a fourth P-type MOS transistor PM31 a fifth P-type MOS transistor PM32. The source electrode of the fourth P-type MOS transistor PM31 is connected to the power voltage source VDD. The gate electrode of the fourth P-type MOS transistor PM31 is connected to the drain electrode thereof. The drain electrode fourth P-type MOS transistor PM31 is connected to the ground potential VSS through a first N-type MOS transistor NM31. The first N-type MOS transistor NM31 is switched on and off by the control signal C_OUT of the second comparator COMP12. The source electrode of the fifth P-type MOS transistor PM32 is connected to the power voltage source VDD. The gate electrode of the fifth P-type MOS transistor PM32 is connected to the gate electrode of the fourth P-type MOS transistor PM31. The drain electrode of the fifth P-type MOS transistor PM32 is connected to the data line D11.

The first current source 120A (shown in FIGS. 5 and 7) and the second current source 120B (shown in FIGS. 5 and 7) having the above-described structures are selectively driven by the level of the control signal C_OUT of the second comparator COMP12 such that the current I1 is discharged from the data line D11 or the current I2 is charged on the data line D11.

Referring to FIGS. 7 and 9, when the third P-type MOS transistor PM21 is turned on by the control signal C_OUT of the second comparator COMP12, a current flows through a first path within the first current source 120A composed of the power voltage source VDD, the first P-type MOS transistor PM22, the third P-type MOS transistor PM21, and the ground potential VSS. Then, the current that flows through the first path flows through a second path composed of the data line D11, the second P-type MOS transistor PM23, and the ground potential VSS in accordance with the principle of current mirror such that the first current source 120A discharges the current I1 from the data line D11. Then, since the first N-type MOS transistor PM31 is turned off, the second current source 120B is not driven.

When the first N-type MOS transistor NM31 is turned on by the control signal C_OUT of the second comparator COMP12, a current flows through a third path of the second current source 120A composed of the power voltage source VDD, the fourth P-type MOS transistor PM31, the first N-type MOS transistor NM31, and the ground potential VSS. Then, the current that flows through the third path flows a fourth path composed of the power voltage source VDD, the fifth P-type MOS transistor PM32, and the data line D11 in accordance with the principle of current mirror such that the second current source 120A charges the current I2 on the data line D11. At this time, since the third P-type MOS transistor PM21 is turned off, the first current source 120A is not driven.

In accordance with embodiments of the present invention, the analog buffer may be provided in the gate driving unit or the data driving unit mounted on the LCD integrated with a driving circuit. In particular, the analog buffer may be provided in the output port of the data driving unit for applying image signals to the data line of the LCD.

In accordance with embodiments of the present invention, the analog buffer can be provided in signal line driving portions of various flat panel display devices such as plasma display panels (PDP), field emission displays (FED), and electroluminescence displays (ELD) that replace cathode ray tubes (CRT), as well as in LCDs. In particular, the analog buffer may be provided in the output port of the signal line driving portion for applying image signals to the signal line of the flat panel display device.

In accordance with the above-described embodiments of the present invention, the level of the input signal to be charged in the data line is compared with the level of the output signal charged on the data line. Accordingly, current is charged on the data line or current is discharged from the data line through the current switching unit. The level of the input signal is made equal to the level of the output signal. Then, the driving of the current switching unit is inhibited such that it is possible to block leakage current in a circuit stand-by mode, except for the charge and the discharge of the data lines. Thus, power consumption is reduced.

In addition, since the output port of the comparator unit is not connected to the data line, even when the load of the data line is large, such as in a high resolution LCD large area LCD, it is possible to reduce the size of the comparator unit and to minimize the amount of leakage current, thereby minimizing power consumption.

When the level of the output signal charged on the data line is higher than the desired level of the data signal, which is referred to as an overshoot phenomenon, the current switching unit is driven in real time in accordance with the result of the comparator unit. Thus, it is possible to stabilize and maintain a correct level of the output signal charged on the data line. Accordingly, desired colors can be correctly displayed on the display panel, thereby improving picture quality.

In accordance with the above-described embodiments of the present invention, since the comparator unit simply compares the level of the input signal to be charged on the data line with the level of the output signal charged on the data line to control the driving of the current switching unit, a pre-charge for driving the comparator unit is not required. Thus, the driving of the analog buffer is simplified and power consumption is reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An analog buffer comprising:

a comparator unit for comparing an input signal to be charged on a data line of a display panel with an output signal charged on the data line of the display panel to output a control signal; and a current switching unit for discharging an output current from the data line of the display panel or charging an input current on the data line of the display panel in accordance with the control signal output by the comparator unit, wherein the current switching unit comprising:

a first current source for discharging an output current from the data line through an eleventh switch turned on or turned off by the control signal output by the comparator unit; and a second current source for charging an input current on the data line through a twelfth switch turned on or turned off by the control signal output by the comparator unit, wherein the comparator unit changes the level of the control signal to charge an input current on the data line when a level of the input signal is higher than a level of the output signal, and the comparator unit changes the level of the control signal to discharge an output current from the data line when the level of the input signal is lower the level of the output signal.

2. The analog buffer according to claim 1, wherein the analog buffer is provided in a data driving unit mounted on a liquid crystal display device integrated with a driving circuit.

3. The analog buffer according to claim 1, wherein the comparator unit includes:

a first comparator for receiving the input signal to be charged on the signal line through a first switch and a first capacitor;

a second switch connected between an input port and an output port of the first comparator to initialize the input port and the output port of the first comparator;

a second comparator for receiving the output signal of the first comparator through a second capacitor to output the control signal;

a third switch connected between an input port and an output port of the second comparator to initialize the input port and the output port of the second comparator; and a fourth switch for applying the input signal charged within the first capacitor to the signal line.

4. The analog buffer according to claim 3, wherein each of the first to fourth switches includes one of an N-type MOS transistor and a P-type MOS transistor.

5. The analog buffer according to claim 3, including a resistor between the fourth switch and the data line.

6. The analog buffer according to claim 3, including a switch between the fourth switch and the data line for precharging or resetting the data line.

7. The analog buffer according to claim 1, wherein the first current source and the second current source form a current mirror.

8. The analog buffer according to claim 1, wherein the first current source includes a first P-type MOS transistor and a second P-type MOS transistor, a drain electrode of the first P-type MOS transistor is grounded through an third P-type MOS transistor whose conduction is controlled by the control signal output by the comparator unit, a gate electrode of the first P-type MOS transistor is connected to the drain electrode thereof, and a source electrode of the first P-type MOS transistor is connected to a power voltage source, and a drain electrode of the second P-type MOS transistor is grounded, a gate electrode of the second P-type MOS transistor is connected to the gate electrode of the first P-type MOS transistor, and a source electrode of the second P-type MOS transistor is connected to the data line.

9. The analog buffer according to claim 1, wherein the second current source includes a fourth P-type MOS transistor and a fifth P-type MOS transistor, a source electrode of the fourth P-type MOS transistor is connected to a power voltage source, a gate electrode of the fourth P-type MOS transistor is connected to a drain electrode thereof, and the drain electrode of the fourth P-type MOS transistor is grounded through a first N-type MOS transistor whose electric connection is controlled by the control signal output by the comparator unit; and a source electrode of the fifth P-type MOS transistor is connected to the power voltage source, a gate electrode of the fifth P-type MOS transistor is connected to the gate electrode of the fourth P-type MOS transistor, and a drain electrode of the fifth P-type MOS transistor is connected to the data line.

10. An analog buffer comprising:

a first comparator for receiving an input signal to be charged on a signal line through a first switch and a first capacitor;

a second switch connected between an input port and an output port of the first comparator to initialize the input port and the output port of the first comparator;

a second comparator for receiving an output signal of the first comparator through a second capacitor to output a control signal;

a third switch connected between an input port and an output port of the second comparator to initialize the input port and the output port of the second comparator;

a first current source for discharging an output current from the signal line through an eleventh switch turned on or turned off by the control signal output by the second comparator;

a second current source for charging an input current on the signal line through a twelfth switch turned on or turned off by the control signal of the second comparator; and a fourth switch for applying the input signal charged within the first capacitor in the signal line.

11. The analog buffer according to claim 10, including a resistor between the fourth switch and the signal line.

12. The analog buffer according to claim 10, including a between the fourth switch and the signal line switch for precharging or resetting the signal line.

13. The analog buffer according to claim 10, wherein the first current source and the second current source form a current mirror.

14. A method of driving an analog buffer, comprising:

initializing an input port and an output port of a comparator unit;

comparing an input signal to be charged on a data signal line of a display panel with an output signal charged on the data signal line of the display panel;

changing a the level of the control signal of the comparator unit to charge an input current on the data signal line when a level of the input signal is higher than a level of the output signal, and charging the input current on the data line in accordance with the control signal;

changing the level of the control signal of the comparator unit to discharge an output current from the data signal line when the level of the input signal is lower than the level of the output signal, and discharging the output current from the data line in accordance with the control signal;

correcting a level of the output signal which is higher than a desired level; and stopping a charge or a discharge of a leakage current.

* * * * *